US005468022A

United States Patent [19]

Linder et al.

[11] Patent Number: 5,468,022

[45] Date of Patent: Nov. 21, 1995

[54] SAMPLE TUBE IDENTIFICATION FLAG

[75] Inventors: Benjamin Linder, Cambridge; Don Lee, Waltham, both of Mass.; Amy Battles, Boise, Id.; Bradley S. Thomas, Timonium, Md.

[73] Assignee: Massachusetts Institute of Technology, Mass.

[21] Appl. No.: 259,444

[22] Filed: Jun. 14, 1994

[51] Int. Cl.[6] ..... B42D 15/00

[52] U.S. Cl. ..... 283/072; 283/79; 283/900; 283/81

[58] Field of Search ..... 283/72, 74, 75, 283/79, 80, 81, 900; 40/310

[56] References Cited

U.S. PATENT DOCUMENTS

| | | | |
|---|---|---|---|
| 3,517,450 | 6/1970 | Greco | 40/310 |
| 3,656,473 | 4/1972 | Sodickson et al. . | |
| 3,781,120 | 12/1973 | Engelhardt . | |
| 3,831,006 | 8/1974 | Chaffin, III et al. . | |
| 4,092,113 | 5/1978 | Hardy . | |
| 4,460,824 | 7/1984 | Kadogaki . | |
| 4,805,772 | 2/1989 | Shaw et al. . | |
| 4,884,827 | 12/1989 | Kelley . | |
| 5,000,484 | 3/1991 | Phelan et al. | 283/900 X |
| 5,019,243 | 5/1991 | McEwen et al. . | |
| 5,048,870 | 9/1991 | Mangini et al. | 283/900 X |
| 5,071,168 | 12/1991 | Shames | 283/900 X |
| 5,135,125 | 8/1992 | Andel et al. | 40/310 X |
| 5,166,498 | 11/1992 | Neeley . | |

*Primary Examiner*—Willmon Fridie, Jr.

*Attorney, Agent, or Firm*—Samuels, Gauthier & Stevens

[57] ABSTRACT

The invention relates to an identification flag for a sample tube. The flag includes a longitudinally extending planar element, and tube connectors extending laterally from the planar element. The tube connectors are engageable with opposite portions of the tube to secure the planar element to the tube in a laterally spaced relationship with respect to an intermediate portion of the tube located between the opposite portions.

23 Claims, 4 Drawing Sheets

SAMPLE TUBE IDENTIFICATION FLAG

BACKGROUND OF THE INVENTION

Conventional sample test tubes are becoming increasingly smaller in diameter with respect to tube length. For example, such sample tubes include evacuated tubes or capillary tubes. Such sample tubes are seldom labelled due to extreme surface limitations and the difficulty in applying such labels to small diameter tubes. The tubes are typically identified by laboratory personnel remembering the position of the tube within a centrifuge tray or rotor, and thereafter manually associating that information with a particular patient.

Alternatively, the sample tubes have been placed within a larger sample tube which in turn is provided with an identification label. However, when the smaller tubes are removed from the larger tube for further testing, the identification must he maintained manually.

Both previously mentioned methods depend heavily upon user memory and the performance of repetitive tasks that are subject to human error. In addition, when a label is directly attached to the sample tube, the label tends to obscure the view of that portion of the tube preventing accurate inspection or testing of the sample fluids held therein.

Accordingly, it is an object of the present invention to provide an identification flag for use with sample tubes for providing a positive identification between a patient fluid sample and the patient records.

It is a further object of the present invention to provide a sample tube identification flag which provides a flat surface area for receiving identification indicia such as written information, machine readable identification code, or related identification labels.

It is yet another object of the present invention to provide a sample tube identification flag which provides a surface for receiving identification data that does not obscure the view of the contents of the sample tube.

A still further object of the present invention is to provide an identification flag for a sample tube which provides a convenient way to handle the tube, and further prevent the handler's fingerprints from getting on the tube.

SUMMARY OF THE INVENTION

The present invention provides an identification flag for use with a sample tube. The flag includes a longitudinally extending planar element, and tube connectors extending laterally from the planar element. The tube connectors are engageable with opposite portions of the tube to secure the planar element to the tube in a laterally spaced relationship with respect to an intermediate portion of the tube located between the opposite portions.

DETAILED DESCRIPTION OF THE ILLUSTRATED EMBODIMENTS

Figure 1:
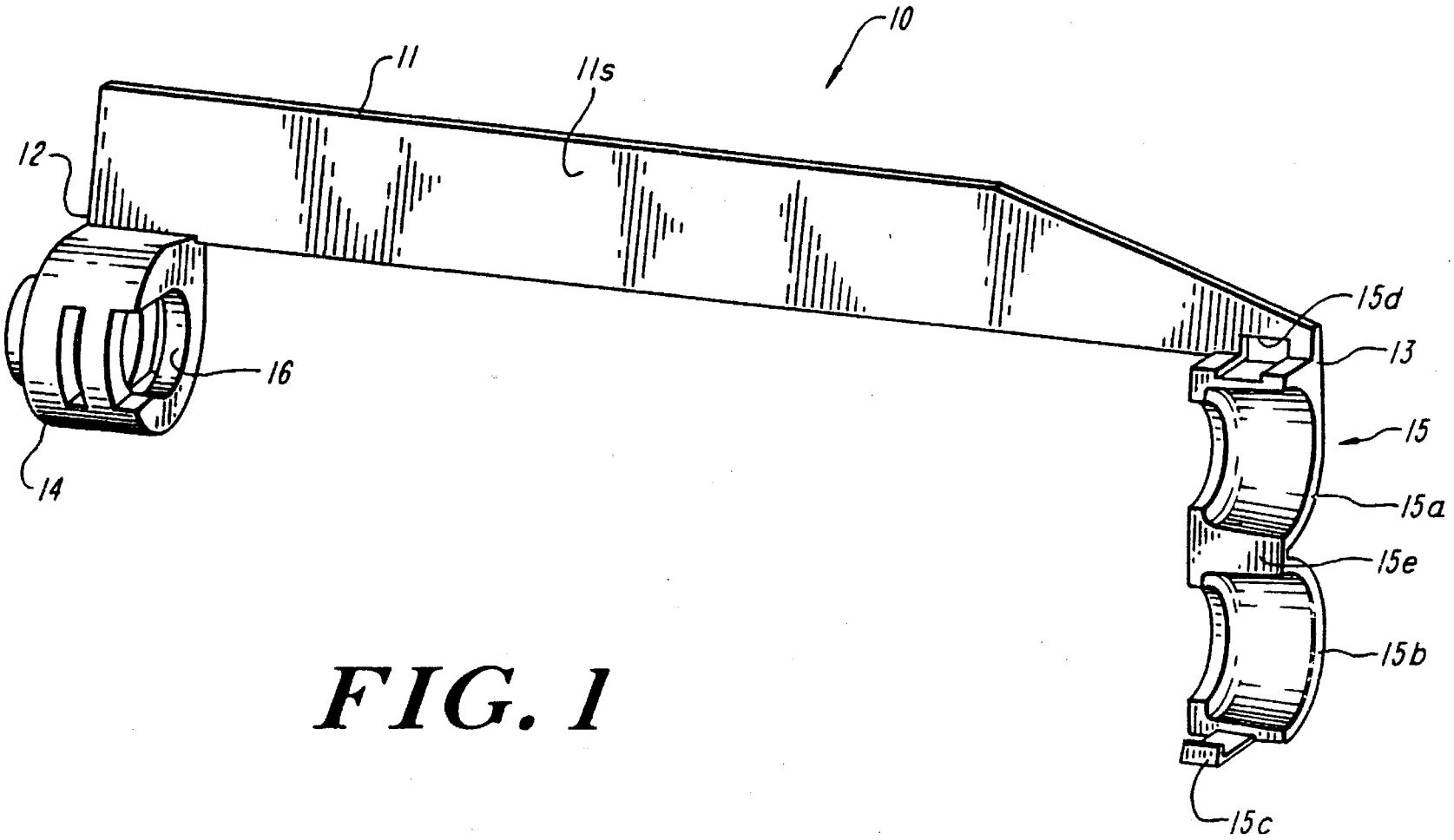
FIG. 1 shows a perspective view of an sample tube identification flag in accordance with the present invention.

With reference now to FIG. 1, an exemplary embodiment of an identification flag 10 in accordance with the present invention is shown in perspective view. The flag 10 includes an elongate planar element 11 having oppositely facing data receiving surfaces 11*s*, and first 12 and second 13 opposite supporting ends.

The first supporting end 12 includes an integrally formed and offsetting tube connector in the form of a retaining seat 14. The retaining seat 14 has a cavity 16 which is configured to receive and retain the bottom end portion of a sample tube.

The second supporting end 13 includes an integrally formed offsetting tube connector in the form of a retaining clasp 15 for securely retaining the top end portion of the sample tube. The clasp 15 is a split collet having arcuate segments 15*a* and 15*b* connected at adjacent ends by an integral living hinge 15*e*. The free end of the segment 15*b* includes a locking tongue portion 15*c* which engages with a slot 15*d* associated with the second end 13. Thus, in use, the top end of the sample tube is seated in the segment 15*a*, and thereafter the segment 15*b* is folded over the test tube and snapped shut by squeezing the clasp so that the tongue 15*c* interacts with the slot 15*d*.

Figure 2:
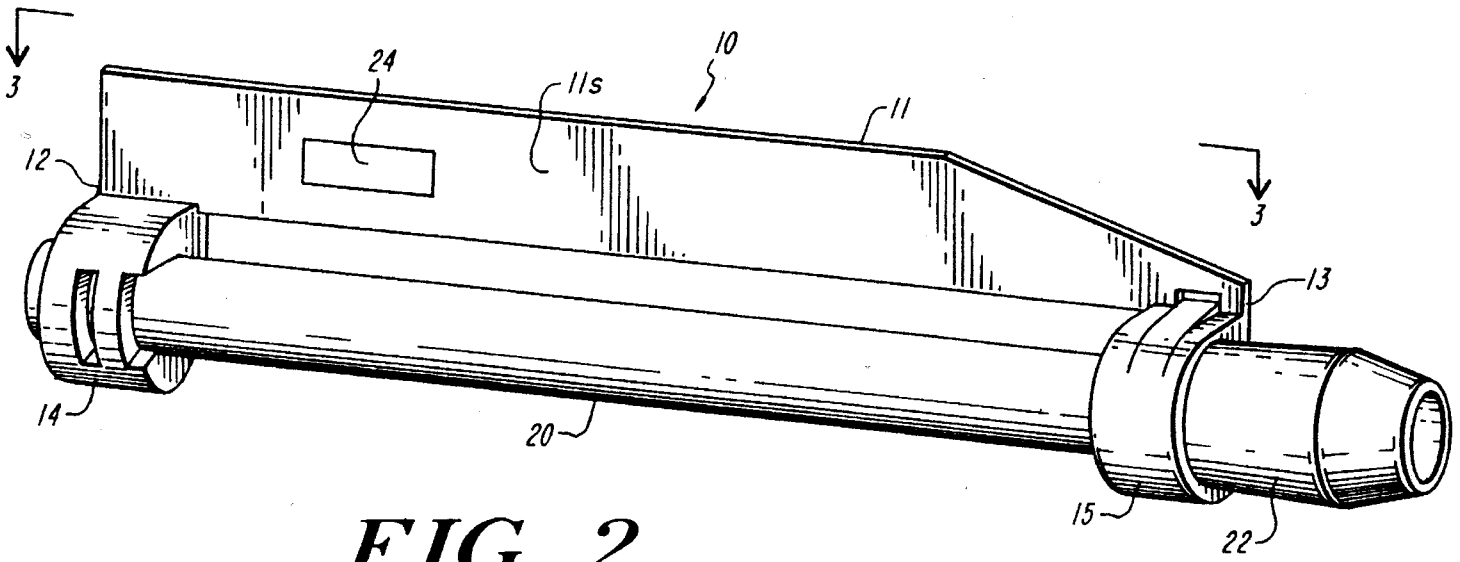
FIG. 2 shows a perspective view of the identification flag in use with a sample tube.

As shown in FIG. 2, when using the flag 10 with an exemplary evacuated tube 20, the clasp 15 surrounds the top end portion of the sample tube just below a vacuum stop end 22 associated with the tube 20. Thereafter, the desired identification data or indicia may be applied to surface 11*s*. It will be appreciated that the flag 10 may be used with a capillary tube, therefore the clasp 15 will be configured to grasp and surround the top end of the tube.

Figure 3:
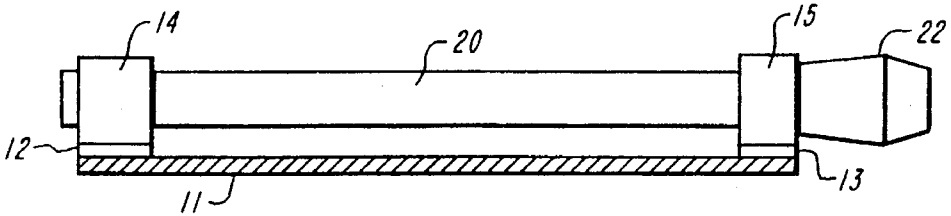
FIG. 3 shows a side view of the identification flag and sample tube taken along line 3—3 of FIG. 2.

As can be seen in FIG. 3, the offsetting planar element 11 is configured to be laterally spaced from the tube so to avoid obscuring the view of the contents of the tube 20. In the exemplary embodiment illustrated, the planar element extends parallel to and outwardly form the tube. The planar element further serves to stabilize the tube 20 when placed flat on a surface, and to further accommodate hand writing indicia onto the surface 11*s*. In addition, the planar element may also be used as a handle for carrying the tube, thus avoiding smearing the tube with fingerprints.

The data receiving surface 11*s* is provided with desired identification data or indicia 24. The data 24 may take the form of any number of conventional identification coding, including handwritten information, bar coded information, serialized preprinted markings, etc. Alternatively, the data 24 may take the form of an applied label which includes unique data associated with the particular sample. In addition, the label can include a plurality of removable label portions so that a copy of the identification data can be removed from the flag and placed directly on a patient record sheet, thus providing a positive link between the patient identification and the sample test tube. The data receiving surface can also be provided with a magnetic data strip containing identification data. The data receiving surface of the element 11 can further be utilized to hand write additional information if desired, such as the patient's name, the date, or the type of test to be performed on the sample. It will be appreciated by those of skill in the art that the opposing data receiving surface of the element 11 can be utilized to receive any of the aforementioned identification data.

Figure 4:
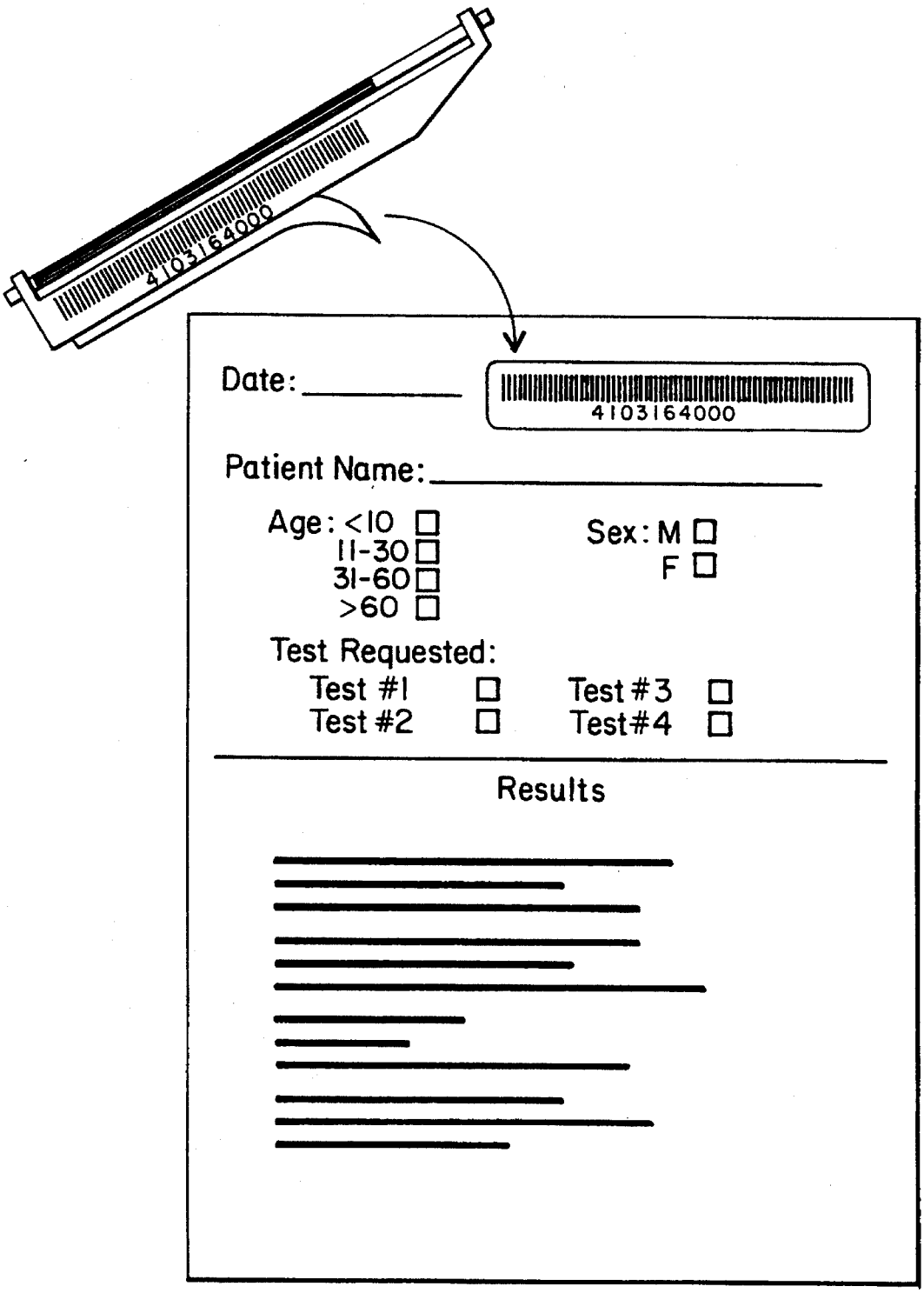
FIG. 4 shows the sample identification flag with removable label indicia provided therewith.

In practice, the sample tube identification flag 10 is utilized in the following manner. Assuming the test tube is filled with the appropriate sample, the sample identification flag in accordance with the present invention is immediately attached to the tube as described above. In other words, the bottom end of the tube is inserted into the retaining seat 14, and the top end of the tube is laid into the open clasp 15 at the opposite end of the flag. The clasp is then folded over the top portion of the test tube and snapped shut. If, for example, the indicia on the data receiving surface 11*s* includes the removable identification label, the label is immediately placed on the patient record as shown in FIG. 4. It will be appreciated that the identification indicia may be preprinted on the surface 11*s* or applied at the time of use in the laboratory.

Figure 5:
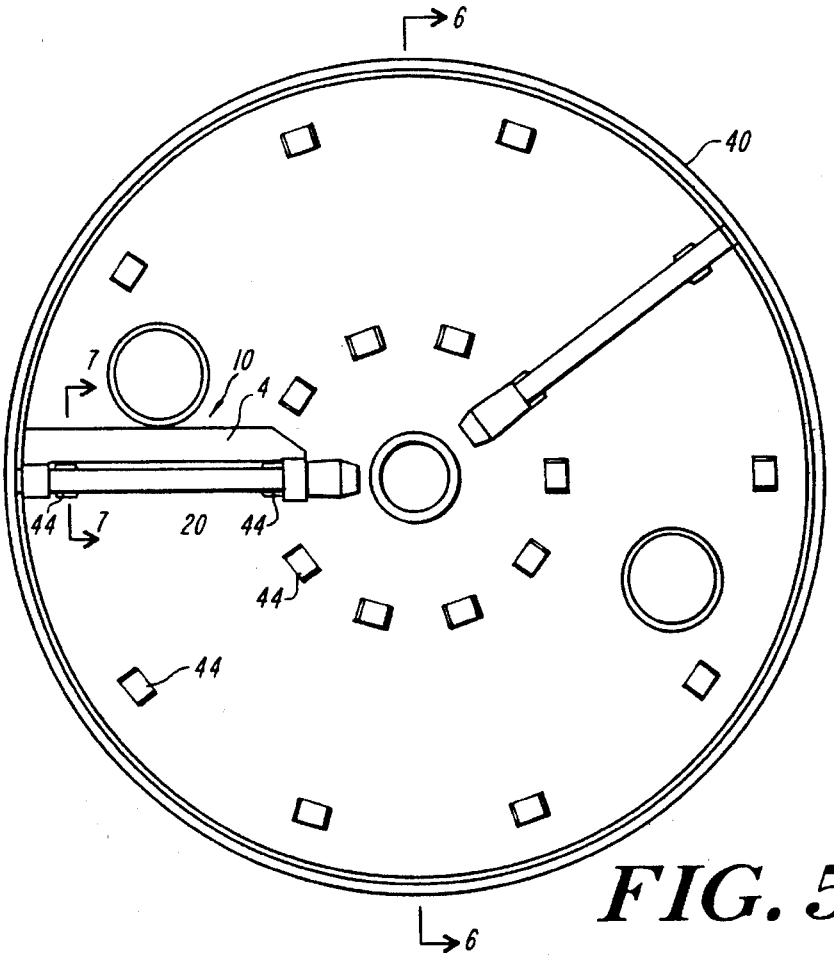
FIG. 5 shows a top view of a centrifuge carousel for use with the present invention.
Figure 6:
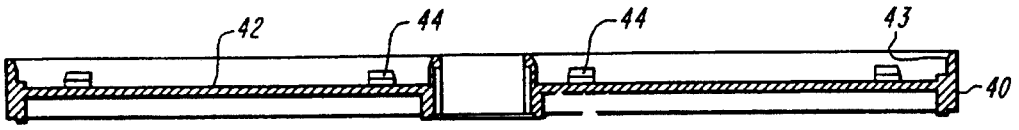
FIG. 6 shows a side view of the carousel taken along line 6—6 of FIG. 5.

Thereafter, the sample tube 20 and attached flag 10 are placed in a carousel 40 as shown in FIGS. 5 and 6. It will be appreciated that the selection of the carousel depends on the type of sample tube utilized, and for exemplary purposes, FIG. 5 illustrates the utilization of the previously described evacuated tube. The carousel 40 is pan-shaped having a bottom surface 42 with a side edge 43. The bottom surface 42 includes a plurality of tube seating bosses 44 aligned within the carousel for stably supporting the sample tubes therein. The carousel 40 is configured to be placed within a corresponding centrifuge rotor pan.

Figure 7:
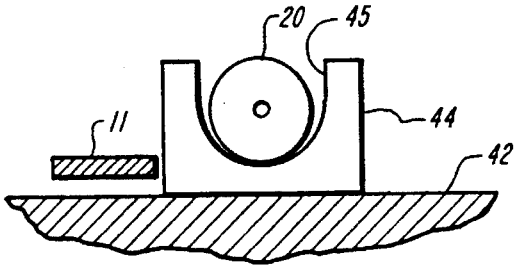
FIG. 7 shows a sectional view of a seating boss of the carousel taken along line 7—7 of FIG. 5.

When placed into the carousel 40, the planar element 11 of the flag 10 fits into a nest on one side of the tube while the tube itself rests in a semicircular channel 45 of the seating boss 44. The raised wall of the boss 44, which is aligned between the element 11 and the tube 20, prevents the tube from being flipped or reversed in the carousel, thus orienting the tube and flag so as to lie flat within the carousel, as best shown in FIG. 7.

The sample tube with the flag 10 is then processed with the necessary tests being performed. Preferably, the tests are performed by a machine that automatically reads the identification label and associates the test results with the identification code provided on the surface 11*s*. Finally, the test results are associated with the patient by matching the test results, now containing the identification code, with the patient record containing the matching identification data. Preferably, this is done with a computer with a scanner than verifies matching codes and prints the correct results directly upon the patient record. Alternatively, the computer can present the results with the identification code to be attached to the patient record in the form of a printout.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. An identification flag for a sample tube, said flag comprising:

a longitudinally extending planar element; and tube connectors extending laterally from said planar element, said tube connectors being engageable with opposite portions of said tube to secure said planar element to said tube in a laterally spaced relationship with respect to an intermediate portion of said tube located between said opposite portions.

2. The flag of claim 1, wherein said planar element comprises oppositely facing identification data receiving surfaces.

3. The flag of claim 2, wherein said data receiving surfaces comprise indicia provided thereon.

4. The flag of claim 3, wherein said indicia comprises barcoded data.

5. The flag of claim 3, wherein said indicia comprises alphanumeric indicia.

6. The flag of claim 3, wherein said indicia comprises identification labels.

7. The flag of claim 6, wherein said identification label comprises first and second portions each of which includes matching identification data, said second portion being removable from said identification label for application to a selected location.

8. The flag of claim 2, wherein said data receiving surfaces comprise magnetic data strips provided thereon.

9. The flag of claim 1, wherein said tube connectors are adapted to engage said tube at opposite ends.

10. The flag of claim 9, wherein said tube connectors comprise a cylindrical seating arranged to surround at least one end of said tube.

11. The flag of claim 9, wherein said tube connectors comprise a clasp arranged to releasably retain at least one end of said test tube.

12. The flag of claim 10, wherein said planar element is arranged to extend parallel to and outwardly from said tube.

13. An identification flag for use with a sample test tube, said flag comprising:

an elongated planar element having first and second ends;

a retaining seat associated with said first end arranged to retain a first portion of said tube; and a securing collet associated with said second end arranged to secure a second portion of said tube, said elongated planar element being in a laterally spaced relationship with respect to a third portion of said tube located between said first and second portions.

14. The flag of claim 13, wherein said retaining seat and said securing collet are arranged to support said tube at opposite ends thereof.

15. The flag of claim 14, wherein said securing collet comprises a clasp arranged to releasably retain one end of said test tube.

16. The flag of claim 13, wherein said planar element is arranged so as to extend parallel to and outwardly from said tube.

17. The flag of claim 13, wherein said planar element comprises oppositely facing identification data receiving surfaces.

18. The flag of claim 17, wherein said data receiving surfaces comprise indicia provided thereon.

19. The flag of claim 18, wherein said indicia comprises barcoded data.

20. The flag of claim 18, wherein said indicia comprises alphanumeric indicia.

21. The flag of claim 18, wherein said indicia comprises identification labels.

22. The flag of claim 17, wherein said data receiving surfaces comprise magnetic data strips provided thereon.

23. The flag of claim 13, wherein said planar element is configured as a handle for carrying said tube.

* * * * *